US008865385B2

(12) United States Patent
Nakayama et al.

(10) Patent No.: US 8,865,385 B2
(45) Date of Patent: Oct. 21, 2014

(54) TONER

(75) Inventors: Kenichi Nakayama, Numazu (JP); Shinya Yachi, Mishima (JP); Takeshi Kaburagi, Suntou-gun (JP); Nobuhisa Abe, Susono (JP); Shiro Kuroki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 15 days.

(21) Appl. No.: 13/821,188

(22) PCT Filed: Sep. 6, 2011

(86) PCT No.: PCT/JP2011/070683
§ 371 (c)(1), (2), (4) Date: Mar. 6, 2013

(87) PCT Pub. No.: WO2012/033220
PCT Pub. Date: Mar. 15, 2012

(65) Prior Publication Data

US 2013/0164670 A1 Jun. 27, 2013

(30) Foreign Application Priority Data

Sep. 8, 2010 (JP) ..... 2010-201066

(51) Int. Cl.
*G03G 9/08* (2006.01)
*G03G 9/087* (2006.01)

(52) U.S. Cl.
CPC ..... *G03G 9/0825* (2013.01); *G03G 9/0804* (2013.01); *G03G 9/08782* (2013.01); *G03G 9/0821* (2013.01); *G03G 9/0806* (2013.01)
USPC ..... 430/108.8

(58) Field of Classification Search
CPC ..... G03G 9/08782
USPC ..... 430/108.8
See application file for complete search history.

(56) References Cited

U.S. PATENT DOCUMENTS

| | | | |
|---|---|---|---|
| 6,203,959 | B1 | 3/2001 | Tanikawa |
| 7,432,030 | B2 | 10/2008 | Tsurumi |

FOREIGN PATENT DOCUMENTS

| | | | |
|---|---|---|---|
| CN | 1749866 | A | 3/2006 |
| JP | 5-313403 | A | 11/1993 |
| JP | 2000-321815 | A | 11/2000 |
| JP | 2001-249486 | A | 9/2001 |
| JP | 2003-131418 | A | 5/2003 |
| JP | 2006-84661 | A | 3/2006 |

*Primary Examiner* — Mark A Chapman
(74) *Attorney, Agent, or Firm* — Canon U.S.A., Inc., IP Division

(57) ABSTRACT

The present invention provides a toner that gives satisfactory fixing image quality in both high-speed fixing process and low-speed fixing process and shows excellent image quality for a long time by inhibiting inside contamination even in repeated use. In a toner including toner particles containing a binder resin, a hydrocarbon wax, and a coloring agent, the hydrocarbon wax is prescribed by a relationship in total amounts of components having carbon atoms in specific ranges in thermal desorption and GC/MS analysis when heated at 200° C. for 10 minutes.

6 Claims, 3 Drawing Sheets

TONER

TECHNICAL FIELD

The present invention relates to a toner that is used in an image-forming method such as electrophotography, an electrostatic recording method, or a toner-jetting system.

BACKGROUND ART

The functions of copiers and printers have been extended nowadays, and with this, there is a demand for a toner that shows satisfactory fixability to plain paper in a high-speed printing process. At the same time, there is a demand for a toner that shows uniform and high glossiness in output onto heavy paper, such as glossy paper, in a low-speed printing process. Thus, in order to form satisfactory images even if the fixing conditions are varied and are hard, waxes contained in toners have been improved. However, when high-speed printing or output onto heavy paper is repeated, the wax contained in a toner contaminates the inside of an image forming apparatus and thus causes another problem. Accordingly, there is a demand for a toner that can prevent contamination of the inside (in particular, near the fixing device) of an apparatus even in use for a long time at high-speed printing or output onto heavy paper.

PTL 1 proposes a toner provided with excellent fixability by including a wax that has a low melting point and a sharp melting property by containing a high content of n-paraffin. PTL 2 proposes a toner provided with excellent hot offset resistance by regulating the average number of carbon atoms of hydrocarbon components of a wax. PTL 3 proposes a toner showing excellent fixability even on heavy paper by using a wax having an endothermic peak observed by DSC in a particular range.

However, though the toners described in PTLs 1 and 2 are excellent in fixability, the prevention of the inside of an apparatus from being contaminated in the fixing process is still insufficient. The toner described in PTL 3 can inhibit contamination of the fixing roller, but sufficient improvement effect is not obtained for inhibiting contamination of the insides of peripheral members of the fixing device.

CITATION LIST

Patent Literature

PTL 1 Japanese Patent Laid-Open No. 2000-321815 (U.S. Pat. No. 6,203,959)

PTL 2 Japanese Patent Laid-Open No. 2006-84661 (U.S. Pat. No. 7,432,030)

PTL 3 Japanese Patent Laid-Open No. 2001-249486

SUMMARY OF INVENTION

The present invention provides a toner showing excellent fixability in both a high-speed process and output onto heavy paper and being capable of exhibiting high image quality over a long time by inhibiting contamination of the inside of an apparatus even in use for a long time.

The present invention relates to a toner comprising toner particles, each of which contains a binder resin, a hydrocarbon wax, and a coloring agent, wherein in GC/MS analysis of components volatilized by heating the hydrocarbon wax at 200° C. for 10 minutes, i) a total amount (A) of components showing peaks that are detected on and after the detection time of the peak of hydrocarbon having 16 carbon atoms is 1500 ppm or less, ii) a total amount (B) of components showing peaks that are detected on and after the detection time of the peak of hydrocarbon having 30 carbon atoms is 570 ppm or less, and iii) when a total amount of components showing peaks that are detected on and after the detection time of the peak of hydrocarbon having 16 carbon atoms and on and before the detection time of the peak of hydrocarbon having 29 carbon atoms is represented by a total amount (C), the total amount (B) and the total amount (C) satisfy a relationship expressed by $(B)/(C) \geq 2.0$.

The present invention can provide a toner showing excellent fixability in both a high-speed process and output onto heavy paper and being capable of exhibiting high image quality over a long time by inhibiting contamination of the inside of an apparatus even in use for a long time.

DESCRIPTION OF EMBODIMENT

Figure 1:
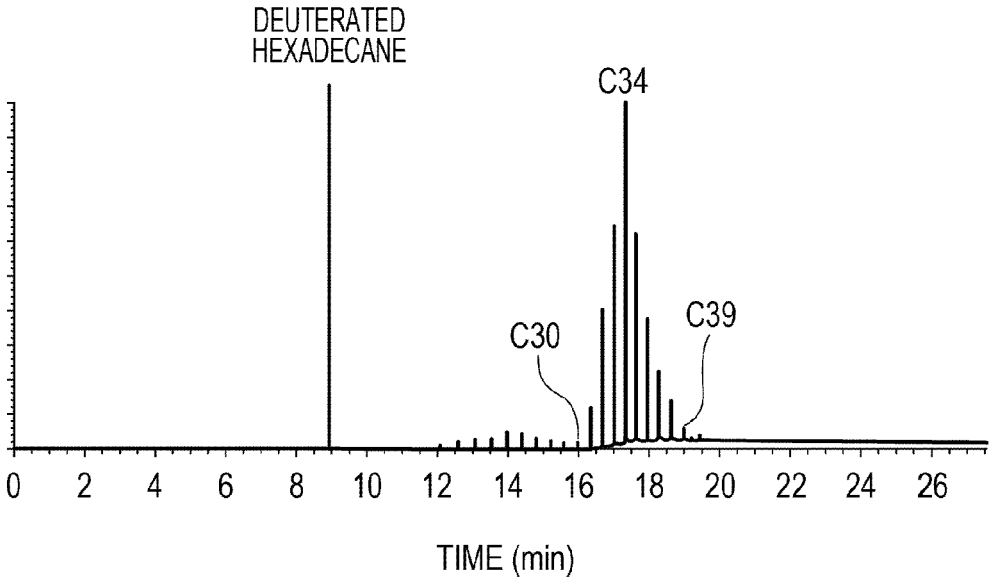
FIG. 1 is a diagram showing the result of GC/MS analysis of components volatilized by heating Wax 1 used in examples of the present invention at 200° C. for 10 minutes.

The present inventors have diligently studied causes of contamination of the insides of copiers and printers and, as a result, have found that there is a high correlation between the amount of a high-boiling-point volatile component contained in toner particles and the state of contamination of the inside of an image forming apparatus (hereinafter referred to as "inside contamination"). Furthermore, the present inventors have studied in detail the relationship between the composition ratio of a high-boiling-point volatile component and the accumulation state of a contaminating material and the mechanism of contamination occurrence under fixing process conditions and have found a wax effective for preventing inside contamination. The effect of wax and the mechanism of inside contamination occurrence will be described below, and then the toner of the present invention will be described in detail.

When a toner containing a wax is heated in a fixing process, the wax is molten, and thereby a plasticization effect and a mold release effect due to the molten wax appear. As a result, the fixability of the toner are improved to prevent offset and contamination of the toner onto a fixing member and also avoid problems such as roll-up at the fixing device and paper jam.

In a high-speed fixing process, the toner needs to be molten instantly at a fixing nip portion. Accordingly, the fixing temperature is set to a high range, and thereby an excessive heat quantity is applied to the toner in many cases. According to the investigation by the present inventors, if continuous printing is performed at the state that an excessive heat quantity is being applied to the toner, a phenomenon that the concentration of the high-boiling-point volatile component from a wax is increased in the image forming apparatus is observed. The high-boiling-point volatile components are instantly cooled when they are brought into contact with structural members in the image forming apparatus and are thereby deposited. The inside contamination is caused by accumulation of the deposited material. The progress of the inside contamination causes a decrease in sensitivity of various control sensors and a decrease in ability of functional members. As a result, the image quality gradually decreases, which requires maintenance or replacement of the members and may reduce the usable period of the image forming apparatus.

On the other hand, images printed on glossy paper are required to have high glossiness similar to that of photographs. Accordingly, in the output on glossy paper, a smooth fixing surface is accomplished by reducing the process speed to sufficiently melt the toner and letting the wax components uniformly spread on a molten resin surface. In such fixing process conditions, the time of heating the toner in the state that the wax has sufficiently spread is lengthened. Therefore, the concentration of the high-boiling-point volatile component from the wax is increased to cause a tendency to accelerate the member contamination.

The toner of the present invention includes toner particles containing a hydrocarbon wax. The hydrocarbon wax is generally nonpolar and therefore has a low compatibility with a styrene-acrylic resin or a polyester resin, which are commonly used as binder resins of toners. Consequently, in a toner containing a hydrocarbon wax, since excessive plasticization of the binder resin is inhibited, excellent developability and offset resistance can be obtained even in high-speed process requiring high durability.

In addition, the hydrocarbon wax is composed of hydrocarbon components having a certain distribution of the number of carbon atoms. Therefore, the high-boiling-point volatile components that will be generated in the fixing process show a carbon atom number distribution characteristic to the wax.

The present inventors have analyzed in detail the inside contaminating components that are generated when the toner contains a hydrocarbon wax and, as a result, have found that there is a relationship between the progress state of the inside contamination and the peak pattern in GC/MS analysis of components volatilized by heating the hydrocarbon wax at 200° C. for 10 minutes. The inventors have thought that the relationship occurs because the heating conditions of a temperature 200° C. for 10 minutes in the above-mentioned analysis are approximate to those of generating the high-boiling-point volatile component in a general image forming apparatus. In addition, the study revealed that a component having 30 or more carbon atoms readily volatiles and deposits in the apparatus and is a major cause of the inside contamination.

From the study described above, it has been revealed that in order to reduce the inside contamination, it is necessary to reduce the total amount of the high-boiling-point volatile components of the hydrocarbon wax contained in toner particles and the total amount of the components having 30 or more carbon atoms in the high-boiling-point volatile components. Accordingly, the hydrocarbon wax contained in the toner of the present invention is characterized in that in GC/MS analysis of components volatilized by heating the hydrocarbon wax at 200° C. for 10 minutes, the total amount (A) of components showing peaks that are detected on and after the detection time of the peak of hydrocarbon having 16 carbon atoms is 1500 ppm or less, and the total amount (B) of components showing peaks that are detected on and after the detection time of the peak of hydrocarbon having 30 carbon atoms is 570 ppm or less. Note that in the present invention, "on and after the detection time of the peak of hydrocarbon having 16 carbon atoms" includes the detection time of the peak of hydrocarbon having 16 carbon atoms, and "on and after the detection time of the peak of hydrocarbon having 30 carbon atoms" includes the detection time of the peak of hydrocarbon having 30 carbon atoms.

The present invention has focused on that volatile components having 16 or more carbon atoms that are generated by heating the hydrocarbon wax are deposited as particles to contaminate the inside of an apparatus. In this specification, the total amount (A) represents the ratio of the total amount of high-boiling-point volatile components that are contained in the hydrocarbon wax and cause the inside contamination. The amount of high-boiling-point volatile components that are generated from the hydrocarbon wax is controlled to be low by controlling the total amount (A) to 1500 ppm or less, and thereby the amount of high-boiling-point volatile components that adhere to the inside of an image forming apparatus, such as a fixing member, can be suppressed. Furthermore, the present invention has focused on that the volatile components having 30 or more carbon atoms that are generated when the hydrocarbon wax is heated are especially easily deposited among the high-boiling-point volatile components and that therefore these components become major causes of the inside contamination. In addition, it has been found that the generation of particles that cause the inside contamination can be inhibited by controlling the total amount (B) to 570 ppm or less. By limiting the total amount (A) and the total amount (B) within the above-mentioned ranges, contamination of the inside of an image forming apparatus can be effectively inhibited, even in the cases of performing continuous output for a long time with a high-speed processing machine and of printing on a large number of sheets such as heavy paper at a low-speed fixing mode.

Furthermore, in GC/MS analysis of components volatilized by heating the hydrocarbon wax contained in the toner of the present invention at 200° C. for 10 minutes, the components showing peaks that are detected on and after the detection time of the peak of hydrocarbon having 16 carbon atoms and on and before the detection time of the peak of hydrocarbon having 29 carbon atoms have relatively low molecular weights. Therefore, these components are thought to be deposited as a liquid or a sticky paste when they are cooled. The deposition of such a liquid or a highly sticky paste-like deposited material tends to cause further adhesion or deposition. Therefore, it is important that this total amount (C) is also small.

In the hydrocarbon wax contained in the toner of the present invention, the above-described total amount (C) and the total amount (B) need to satisfy the relationship: (B)/(C) ≥2.0. Among the high-boiling-point volatile components, an increase in the ratio of the components having 30 or more carbon atoms to the components having 16 or more and 29 or less carbon atoms increases the adhesiveness of the deposited material, resulting in an increase in the degree of adhesion of the high-boiling-point volatile components to the inside of an image forming apparatus. In addition, since the components having 16 or more and 29 or less carbon atoms have relatively high volatility, an increase in the ratio of these components in the high-boiling-point volatile components enlarges the range of the inside contamination. When the value of (B)/(C) satisfies the above-mentioned relationship, the diffusion of the high-boiling-point volatile components that are generated in the actual fixing process is inhibited, and the adhesiveness of the deposited material is also decreased. Consequently, the effect of inhibiting accumulation of contaminating material over a long time is increased.

Furthermore, when the total amount (C) is 200 ppm or less, contamination of the inside of an image forming apparatus, such as a fixing member, which occurs when output on a large number of sheets is repeated, in particular, at a glossy paper mode, is inhibited. In addition, adhesion of high-boiling-point volatile components, which suddenly occurs, can be reduced even under a severe environment, such as a high-temperature high-humidity environment or a low-temperature low-humidity environment. Note that in the present invention, "on and before the detection time of the peak of hydrocarbon having 29 carbon atoms" includes the detection time of the peak of hydrocarbon having 29 carbon atoms.

Measurement of Volatile Component Concentration in Wax Using Thermal Desorption Apparatus The concentration of the volatile components in the wax in the present invention is measured as follows. Thermal desorption is performed by an auto thermal desorption (ATD) method. As the measurement apparatus, the following apparatuses are used:

Thermal desorption apparatus: TurboMatrix ATD (manufactured by Perkin-Elmer Corp.), and GC/MS: TRACE DSQ (manufactured by Thermo Fisher Scientific Inc.).

Preparation of Glass Tube Containing Internal Standard Substance

A glass tube packed with 10 mg of Tenax TA adsorbent held by glass-wool is prepared in advance for a thermal desorption apparatus, and the tube is subjected to conditioning at 300° C. for 3 hours under a flow of an inert atmospheric gas. Then, 5 μL of a solution of 100 ppm deuterated n-hexadecane (n-hexadecane D34) in methanol is subjected to adsorption to Tenax TA to obtain a glass tube containing internal standard substance.

Note that in the present invention, deuterated n-hexadecane, which shows a peak at a retention time different from that of the n-hexadecane peak, is used as the internal standard substance in order to distinguish the peak from the peak of n-hexadecane contained in a wax to be analyzed and that the concentration of volatile components in the present invention are all deuterated n-hexadecane equivalents. The conversion process of the concentrations of volatile components will be described below.

Measurement of Wax

About 1 mg of a wax weighed and wrapped with aluminum foil burned at 300° C. in advance is put in a dedicated tube prepared in the "Preparation of glass tube containing internal standard substance". The tube is closed with a Teflon (registered trademark) cap for a thermal desorption apparatus, and this sample is set to thermal desorption apparatus. The sample is subjected to measurement under the following conditions, and the retention time and peak area of the volatile component from the internal standard substance and the total area of peaks on and after hexadecane excluding the peak of the volatile component from the internal standard substance are calculated.

Thermal Desorption Apparatus Conditions

Tube temperature: 200° C.

Transfer temperature: 300° C.

Valve temperature: 300° C.

Column pressure: 150 kPa

Inlet split: 25 mL/min

Outlet split: 10 mL/min

Secondary adsorption tube material: Tenax TA

Retention time: 10 min

Secondary adsorption tube temperature after desorption: −30° C.

Secondary adsorption tube desorption temperature: 300° C.

GC/MS Conditions

Column: Ultra alloy (metal column) UT-5 (internal diameter: 0.25 mm, liquid phase: 0.25 μm, length: 30 m)

Column temperature-rising conditions: 60° C. (retention time: 3 min), temperature rising from 60° C. to 350° C. (temperature-rising rate: 20.0° C./min), 350° C. (retention time: 10 min)

Note that the GC column is directly connected to the transfer line of the thermal desorption apparatus, and the inlet of the GC column is not used.

Analysis

All peaks after the retention time of n-hexadecane, excluding the peak of deuterated n-hexadecane serving as the internal standard substance, obtained by the above-described procedure are integrated to calculate the total area of all peaks. Then, the concentration of the volatile components of the wax is calculated by the following expression. In this occasion, it is necessary to pay attention not to add noise peaks differing from the peaks to the integration value.

$$\text{Volatile component concentration in wax (ppm)}=[(a1/b1)\times\{(100\times5/1000000)\times0.77\}/c1]\times1000000$$

a1: all peak areas after n-hexadecane (excluding the peak of deuterated n-hexadecane), b1: peak area of deuterated n-hexadecane (internal standard substance), c1: weight of the weighed wax (mg), and 0.77 (g/mL): density of deuterated n-hexadecane (internal standard substance).

The value obtained by the above-mentioned analysis is defined as the total amount (A) of components showing peaks that are detected on and after the detection time of the peak of hydrocarbon having 16 carbon atoms. Furthermore, the peak of the hydrocarbon having 30 carbon atoms is identified, and the total area a2 of all peaks detected on and after the detection time of the peak of hydrocarbon having 30 carbon atoms is calculated by integrating these peaks. The value obtained by changing the a1 in the above-mentioned expression to the a2 is defined as the total amount (B). In addition, the total area a3 of all peaks detected on and after the detection time of the peak of hydrocarbon having 16 carbon atoms (excluding the peak of deuterated n-hexadecane) and on and before the detection time of the peak of hydrocarbon having 29 carbon atoms (including the peak of hydrocarbon having 29 carbon atoms) is calculated by integrating these peaks, and the value obtained by changing the a1 in the above-mentioned expression to the a3 is defined as the total amount (C). In a wax not containing a hydrocarbon component having 30 carbon atoms, the value (B) is calculated by using the retention time of which a hydrocarbon standard substance having 30 carbon atoms is measured in advance. The same is applied to waxes not containing a hydrocarbon component having 16 carbon atoms or 29 carbon atoms.

In the toner of the present invention, the peak top temperature of the maximum endothermic peak in differential scanning calorimetry (DSC) can be 50° C. or more and 110° C. or less. When the peak top temperature of the maximum endothermic peak in DSC measurement of a toner is 50° C. or more, the formation of contamination domain adhering to members inside an apparatus can be reduced. This allows the image forming apparatus to be used for a long time. When the peak top temperature of the maximum endothermic peak of a toner is 110° C. or less, an excellent effect of preventing offset in a high-speed apparatus can be obtained.

In the toner of the present invention, the endothermic amount of the endothermic peak in DSC measurement can be 2.0 J/g or more and 20.0 J/g or less. By controlling the endothermic amount of the endothermic peak of a toner within this range, the gloss is uniform and stable to show excellent fixing quality, and development stability and inhibition of inside contamination are also enhanced.

The hydrocarbon wax contained in the toner of the present invention can have a peak molecular weight of $4.0\times10^2$ or more and $1.4\times10^3$ or less measured by gel permeation chromatography (GPC). In addition, the molecular weight distribution (Mw/Mn) of the hydrocarbon wax measured by GPC can be 1.0 or more and 5.0 or less. When the peak molecular weight of a hydrocarbon wax is $4.0\times10^2$ or more, the progress of inside contamination can be inhibited. When the peak molecular weight is $1.4\times10^3$ or less, a sufficient fixing effect can be obtained. When the molecular weight distribution (Mw/Mn) of a wax is 1.0 or more, the wax more effectively functions under the fixing conditions in a high-speed process. When the molecular weight distribution is 5.0 or less, a stable fixing available temperature range for both a low-speed process to heavy paper and a high-speed process to plain paper is obtained. Note that Mw means weight-average molecular weight and that Mn means number-average molecular weight.

The content of the hydrocarbon wax contained in the toner of the present invention can be 1.0 part by mass or more and 17.0 parts by mass or less, preferably 2.0 parts by mass or more and 17.0 parts by mass or less, and more preferably 4.0 parts by mass or more and 17.0 parts by mass or less, based on 100 parts by mass of the binder resin in the toner. By controlling the content of the wax within the above-mentioned range, a toner that shows effective fixability and sufficient durable development quality can be obtained.

Examples of the hydrocarbon wax used in the present invention include polyolefins purified from low-molecular-weight by-products generated during polymerization of high-molecular-weight polyolefins; polyolefins polymerized using a catalyst such as a Ziegler catalyst or a metallocene catalyst; paraffin waxes and Fischer-Tropsch waxes; synthetic hydrocarbon waxes synthesized by a synthol method, a hydrocoal method, or an Arge method from coal gas or natural gas; synthesized waxes obtained from a monomer compound having one carbon atom; hydrocarbon waxes having functional groups such as a hydroxyl group and a carboxyl group; and mixtures of a hydrocarbon wax and a hydrocarbon wax having a functional group. These waxes may be used by narrowing the molecular weight distribution through, for example, a press sweating method, a solvent method, a recrystallization method, a vacuum distillation method, a supercritical gas extraction method, or a melt crystallization method. Additionally, low-molecular-weight solid fatty acids, low-molecular-weight solid alcohols, low-molecular-weight solid compounds, and other materials from which impurities are removed may be used. Among the above, paraffin waxes, Fischer-Tropsch waxes, microcrystalline waxes, polyethylenes synthesized using a metallocene catalyst, distillation purified materials of low-molecular-weight by-products generated during polyethylene polymerization, and polypropylenes synthesized using a metallocene catalyst can be particularly used. Furthermore, the wax contained in the toner of the present invention can be a paraffin wax, a Fischer-Tropsch wax, or a microcrystalline wax, particularly from the viewpoint of demand for efficiently removing high-boiling-point volatile components. Distillation of these waxes can reduce the amounts of high-boiling-point volatile components generated to give a significant effect of inhibiting inside contamination. The distillation of a wax can be performed particularly by a combination of short path distillation and molecular distillation.

For example, distillation can be performed as follows. A wax as a raw material is subjected to short path distillation under conditions of a pressure of 1 to 10 Pa and a temperature of 180 to 200° C., and a process of removing the initial fraction is repeated to obtain the wax fraction. Subsequently, the wax fraction is subjected to molecular distillation under conditions of a pressure of 0.1 to 0.5 Pa and a temperature of 190 to 220° C. to remove hydrocarbon components that cause inside contamination.

According to the investigation by the present inventors, it has been revealed that the high-boiling-point volatile components can be efficiently removed by the molecular distillation when distillation residues as well as the initial fraction components are removed in advance by the short path distillation.

An example of the short path distillation apparatus particularly suitable for the present invention is a wiped-film distillation apparatus.

In the present invention, in addition to the hydrocarbon wax, a polar wax such as an ester wax may be used for supplementing the mold release effect and the plasticization effect of the resin. The polar wax can show a peak top temperature of the maximum endothermic peak of 70 to 110° C., and examples such a wax include carnauba waxes and their derivatives including oxides, block copolymers with vinyl monomers, and graft-modified products, and the examples also include alcohol waxes, fatty acid waxes, acid amide waxes, ester waxes, ketone waxes, hydrogenated castor oil and their derivatives, plant waxes, animal waxes, and montan waxes. In particular, a carnauba wax, a straight-chain alcohol wax, a fatty acid wax, an acid amide wax, an ester wax, or a montan wax derivative can be used as the polar wax. The polar wax is effective when the content thereof is, as the total amount with the hydrocarbon wax used in the present invention, 1.0 parts by mass or more and 20.0 parts by mass or less based on 100.0 parts by mass of the binder resin.

Examples of the binder resin contained in the toner include the following polymers: polystyrenes; homopolymers of styrene substitutes such as poly(vinyl toluene); styrene copolymers such as styrene-vinyl toluene copolymers, styrene-acrylic acid ester copolymers, styrene-methacrylic acid ester copolymers, styrene-acrylonitrile copolymers, styrene-vinyl methyl ether copolymers, styrene-vinyl ethyl ether copolymers, styrene-vinyl methyl ketone copolymers, and styrene-acrylonitrile-indene copolymers; and acrylic resins, methacrylic resins, poly(vinyl acetate), silicone resins, polyester resins, polyurethane, polyamide resins, furan resins, epoxy resins, xylene resins, poly(vinyl butyral), terpene resins, and petroleum resins. In particular, a styrene copolymer or a polyester resin can be used as the binder resin. The glass transition point (Tg) of the binder resin can be 45 to 65° C., preferably 50 to 55° C.

The toner of the present invention includes a coloring agent for exhibiting its coloring ability. Examples of the coloring agent that can be used in the present invention include the following organic pigments, organic dyes, and inorganic pigments.

As the organic pigment or the organic dye serving as a cyan coloring agent, a copper phthalocyanine compound, a derivative thereof, an anthraquinone compound, or a basic dye chelate compound can be used. Specific examples thereof include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, and C.I. Pigment Blue 66.

Examples of the organic pigment or the organic dye serving as a magenta coloring agent include condensed azo compounds, diketopyrrolopyrrole compounds, anthraquinone, quinacridone compounds, basic dye chelate compounds, naphthol compounds, benzimidazolone compounds, thioindigo compounds, and perylene compounds. Specific examples thereof include C.I. Pigment Red 2, C.I. Pigment Red 3, C.I. Pigment Red 5, C.I. Pigment Red 6, C.I. Pigment Red 7, C.I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254.

As the organic pigment or the organic dye serving as a yellow coloring agent, a compound represented by a condensed azo compound, an isoindolinone compound, an anthraquinone compound, an azo metal complex, a methine compound, or an allylamide compound can be used. Specific examples thereof include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191, and C.I. Pigment Yellow 194.

As a black coloring agent, a carbon black, a magnetic substance, or a black mixture of the above-mentioned yellow, magenta, and cyan coloring agents is used.

These coloring agents can be used alone, in admixture, or in a state of solid solution. The coloring agents that are used in the toner of the present invention are selected from the viewpoints of hue angle, saturation, brightness, light resistance, OHP transparency, and dispersibility into the toner. The coloring agents excluding the magnetic substance can be added in an amount of 1 part by mass or more and 20 parts by mass or less based on 100 parts by mass of the binder resin. When the coloring agent is a magnetic substance, the magnetic substance can have a number-average particle diameter of 2 μm or less, preferably 0.1 μm or more and 0.5 μm or less, and can be added in an amount of 20 parts by mass or more and 200 parts by mass or less based on 100 parts by mass of the polymerizable monomer or the binder resin, preferably 40 parts by mass or more and 150 parts by mass or less based on 100 parts by mass of the binder resin.

In the toner of the present invention, a charge control agent may be mixed with toner particles according to need. By blending a charge control agent, the charge characteristics are stabilized, and frictional electrification amount can be optimized according to the development system. Any known charge control agent, in particular, a charge control agent that shows a high frictional electrification speed and stably maintains a constant frictional electrification amount, can be used. Examples of the charge control agent that controls the toner to a negative charge include organometallic compounds, chelate compounds, monoazo metal compounds, acetylacetone metal compounds, metal compounds of aromatic oxycarboxylic acids, aromatic dicarboxylic acids, oxycarboxylic acid, and dicarboxylic acid; aromatic oxycarboxylic acids, aromatic mono- and poly-carboxylic acids, and metal salts, anhydrides, and esters thereof; phenol derivatives such as bisphenol; urea derivatives; metal-containing salicylic acid compounds; metal-containing naphthoic aid compounds; boron compounds; quarternary ammonium salts; calixarene; and resin charge control agents. Examples of the charge control agent that controls the toner to a positive charge include guanidine compounds; imidazole compounds; quaternary ammonium salts such as tributylbenzyl ammonium-1-hydroxy-4-naphthosulfonate and tetrabutyl ammonium tetrafluoroborate, their analogs, that is, onium salts such as phosphonium salts, and lake pigments thereof; triphenylmethane dyes and lake pigments thereof (the laking agents include phosphotungstic acid, phosphomolybdic acid, phosphotungsten molybdic acid, tannic acid, lauric acid, gallic acid, ferricyanates, and ferrocyanates); metal salts of higher aliphatic acids; and resin charge control agents. The toner of the present invention can contain these charge control agents alone or in combination of two or more thereof. Among these charge control agents, from the viewpoints of charge rise-up properties and charge stability, metal-containing salicylic acid compounds, in particular, aluminum or zirconium-containing salicylic acid, can be used. Particularly, an aluminum 3,5-di-tert-butylsalicylate compound can be used as the charge control agent. The charge control agent can be blended in an amount of 0.01 parts by mass or more and 5 parts by mass or less, preferably 0.05 parts by mass or more and 4.5 parts by mass or less, based on 100 parts by mass of the binder resin.

Furthermore, in the present invention, a charge control resin for supplementing charge-retaining ability can be contained according to need. As the charge control resin, a polymer having a side chain of a surfonic acid group, a sulfonate group, or a sulfonic acid ester group can be used. In particular, a polymer or a copolymer of a surfonic acid group, a sulfonate group, or a sulfonic acid ester group can be used. Examples of a monomer having a surfonic acid group, a sulfonate group, or a sulfonic acid ester group for producing the charge control resin include styrenesulfonic acid, 2-acrylamide-2-methylpropane sulfonic acid, 2-methacrylamide-2-methylpropane sulfonic acid, vinyl sulfonic acid, methacrylsulfonic acid, and alkyl esters thereof. The polymer containing a surfonic acid group, a sulfonate group, or a sulfonic acid ester group may be a homopolymer of the above-mentioned monomer or a copolymer of the above-mentioned monomer and another monomer. The monomer that forms the copolymer together with any of the above-mentioned monomers can be a vinyl polymerizable monomer, and also the monofunctional polymerizable monomers or multifunctional polymerizable monomers exemplified in the explanation of the binder resin components can be used. The polymer having a sulfonic acid group can be added in an amount of 0.01 parts by mass or more and 5.00 parts by mass or less, preferably 0.10 parts by mass or more and 3.00 parts by mass or less, based on 100 parts by mass of the polymerizable monomer or the binder resin. When the polymer having, for example, a sulfonic acid group is added in an amount within the above-mentioned range, the charge stabilizing effect of the toner particles can be sufficiently shown to give excellent environmental characteristics and durability characteristics.

The toner of the present invention can contain inorganic fine powders such as silica, alumina, or titania for improving frictional electrification stability, developability, fluidity, and durability. The main component of the inorganic fine powders to be added can be silica, in particular, silica fine powders having a number-average primary particle diameter of 4 nm or more and 80 nm or less. In the present invention, when the number-average primary particle diameter is within the above-mentioned range, the fluidity of the toner and also the storage stability of the toner are improved. The number-average primary particle diameter of the inorganic fine powders is measured as follows. The inorganic fine powders are observed with a transmission electron microscope (magnification: 50000 times, the object of the observation is particles of 1.0 nm or more and 1000 nm or less in diameter), and the major axes of 100 particles in the viewing field are measured, and the average particle diameter thereof is calculated. The particle diameters of the inorganic fine powders on the toner particles are measured with a scanning electron microscope, and the number-average primary particle diameter is determined by the same procedure as above. In addition, fine powders may be a combination of silica with, for example, titanium oxide, alumina, or a complex oxide thereof, in particular, a combination of silica and titanium oxide.

When the inorganic fine powders in a toner absorb moisture, the frictional electrification amount as the toner decreases, and the developability and transcription ability tend to decrease. Accordingly, in order to inhibit moisture absorption by the inorganic fine powders and obtain functions of adjusting the frictional electrification amount of the toner, improving the environmental stability, and improving the characteristics under a high-humidity environment, the inorganic fine powders can be subjected to hydrophobization treatment. Examples of the treatment agent for the hydrophobization treatment of the inorganic powders include unmodified silicone varnishes, various types of modified silicone varnishes, unmodified silicone oils, various types of modified silicone oils, silane compounds, silane coupling agents, other organic silicon compounds, and organic titanium compounds. These treatment agents may be used alone or in combination. Among them, in particular, inorganic fine powders treated with a silicone oil can be used. Furthermore, silicone-oil-treated inorganic fine powders that have been treated with a silicone oil simultaneously or after the hydrophobization treatment with a coupling agent can maintain a high frictional electrification amount of toner particles even under a high-moisture environment to reduce selective development.

The toner participles constituting the toner of the present invention may be produced by any known method such as pulverization, suspension polymerization, or emulsion aggregation, and can be particularly produced in an aqueous dispersion medium, which can give toner particles excellent in development stability even if a large amount of wax components are added. Examples of the method of producing toner particles in an aqueous dispersion medium include an emulsion aggregation method in which an emulsion composed of toner essential components is aggregated in an aqueous dispersion medium; a suspension granulation method in which toner essential components are dissolved in an organic solvent, followed by granulation in an aqueous dispersion medium, and then the organic solvent is volatilized; a suspension or emulsion polymerization method in which a polymerizable monomer dissolving toner essential components is directly granulated in an aqueous dispersion medium and then polymerized; a method in which toner particles are provided with outer layers through seed polymerization; and microcapsulation methods represented by interfacial polycondensation and drying in liquid.

The toner particles of the present invention can be particularly produced by suspension polymerization. In the suspension polymerization, a polymerizable monomer composition is prepared by uniformly dissolving or dispersing a wax and a coloring agent (and, optionally, a polymerization initiator, a cross-linking agent, a charge control agent, and other excipients) in a polymerizable monomer. This polymerizable monomer composition is added to an aqueous dispersion medium containing a dispersion stabilizer and is dispersed therein using an appropriate stirrer for granulation. Then, the polymerizable monomer in the polymerizable monomer composition is polymerized to obtain toner particles having a desired particle diameter. After the completion of the polymerization, the toner particles are subjected to filtration, washing, and drying by known methods and are optionally mixed with a fluidity-improving agent so that the agent adhere to the surfaces of the particles to obtain a toner.

In the case of producing the toner particles by suspension polymerization, it is necessary to use a wax showing a peak top temperature of the maximum endothermic peak of 85° C. or less in DSC measurement for obtaining good granulation properties when the polymerizable monomer composition is granulated in an aqueous medium. Note that the peak top temperature of the maximum endothermic peak of a wax corresponds to the melting point of the wax.

However, when such a wax having a relatively low melting point is used, the toner containing the wax tends to cause inside contamination. In order to solve the problem that particularly occur when toner particles are produced by suspension polymerization, it is specifically effective to use the above-mentioned hydrocarbon wax. That is, by using a hydrocarbon wax having a low melting point that satisfies the requirements of the above-mentioned total amount (A), the total amount (B), and the total amount (C), granulation can be satisfactorily performed, and a toner that hardly cause inside contamination can be obtained.

The dispersing agent used in the preparation of the aqueous dispersion medium may be a known inorganic or organic dispersing agent. Specific examples of the inorganic dispersing agent include tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina. Examples of the organic dispersing agent include poly(vinyl alcohol), gelatin, methyl cellulose, methyl hydroxypropyl cellulose, ethyl cellulose, a sodium salt of carboxymethyl cellulose, and starch.

In addition, commercially available nonionic, anionic, and cationic surfactants can be used, and examples thereof include sodium dodecylbenzenesulfonate, sodium dodecyl sulfate, sodium tetradecyl sulfate, sodium pentadecyl sulfate, sodium octyl sulfate, sodium oleate, sodium laurate, potassium stearate, and calcium oleate. The dispersing agent used in the preparation of the aqueous dispersion medium used for the toner of the present invention can be a poor water-soluble inorganic dispersing agent, in particular, an acid-soluble, poor water-soluble, inorganic dispersing agent.

Furthermore, in the present invention, when the aqueous dispersion medium is prepared using a poor water-soluble inorganic dispersing agent, the amount of the dispersing agent used can be 0.2 parts by mass or more and 2.0 parts by mass or less based on 100 parts by mass of the polymerizable monomer. In addition, in the present invention, the aqueous dispersion medium can be prepared using water in an amount of 300 parts by mass or more and 3000 parts by mass or less based on 100 parts by mass of the polymerizable monomer composition.

In the present invention, when an aqueous dispersion medium in which the above-mentioned poor water-soluble inorganic dispersing agent is dispersed is prepared, a commercially available dispersing agent may be directly used. Furthermore, in order to obtain dispersing agent particles having a fine and uniform particle size, an aqueous dispersion medium may be prepared by generating the above-mentioned poor water-soluble inorganic dispersing agent in a liquid medium such as water with high-speed stirring. For example, in the case of using tricalcium phosphate as the dispersing agent, a desired dispersing agent can be obtained by forming fine particles of tricalcium phosphate through mixing an aqueous solution of sodium phosphate and an aqueous solution of calcium chloride with high-speed stirring. The toner of the present invention can be used as a two-component developer by using with a carrier. The carrier that is used in the two-component developing method may be a known one, and specifically, particles having average particle diameter of 20 to 300 μm made of iron, nickel, cobalt, manganese, chromium, a metal such as a rare-earth element, or an alloy or oxide thereof are used. In addition, a magnetic substance dispersing carrier in which the magnetic substance is dispersed in a resin or a low specific gravity carrier in which porous iron oxide is filled with a resin can be also used.

Furthermore, these carrier particles may have surfaces to which a resin, such as a styrene resin, an acrylic resin, a silicone resin, a fluorine resin, or a polyester resin, adhering or surfaces covered with such a resin.

The methods of measuring physical properties according to the present invention will be described below.

(1) Peak Top Temperatures of Maximum Endothermic Peaks of Toner and Wax, and Endothermic Amount of Toner The peak top temperatures of maximum endothermic peaks of a toner and a wax, and the endothermic amount of a toner are measured in accordance with ASTM D3418-82 using a differential scanning calorimeter, "Q1000" (manufactured by TA Instruments Japan Inc.).

The temperature of the detector of an apparatus is corrected using the melting points of indium and zinc, and the heat quantity is corrected using the melting heat of indium.

Specifically, about 5 mg of a toner or a wax is precisely weighed as a measurement sample and is put in an aluminum pan. As a reference, an empty aluminum pan is used. The measurement is conducted by increasing the temperature of each pan in a measurement temperature range of 30 to 200° C. at a heating rate of 10° C./min. In the measurement, the temperature is increased to 200° C. once and is then decreased to 30° C. Subsequently, the temperature is increased again. The peak top temperature in the maximum endothermic peak of a DSC curve in the temperature range of 30 to 200° C. of this second temperature-increasing process is defined as the peak top temperature of the maximum endothermic peak of an endothermic curve in the DSC measurement of the toner or the wax of the present invention. The endothermic amount obtained in this measurement of the toner is defined as the endothermic amount of the endothermic peak in the differential scanning calorimetry (DSC) measurement in the present invention.

(2) Gel Permeation Chromatography (GPC) of Wax

Molecular weight distribution of a wax is measured as follows by gel permeation chromatography (GPC).

Special grade 2,6-di-t-butyl-4-methylphenol (BHT) is added to o-dichlorobenzene for gel chromatography at a concentration of 0.10% (mass/volume), followed by dissolution at room temperature. A wax and this o-dichlorobenzene containing BHT are placed in a sample bottle and are heated on a hot-plate, set to a temperature of 150° C., to dissolve the wax. After dissolving of the wax, the solution is put in a filter unit heated in advance, and the filter unit is set to the main body. The solution passed through the filter unit is used as a GPC sample. The concentration of the sample solution is adjusted to about 0.15% by mass. This sample solution is subjected to measurement under the following conditions:

Apparatus: HLC-8121GPC/HT (manufactured by Tosoh Corporation)
Detector: R1 for high temperature
Column: TSK gel GMHHR-H HT×2 (manufactured by Tosoh Corporation)
Temperature: 135.0° C.
Solvent: o-dichlorobenzene for gel chromatography (containing 0.10% (mass/volume) of BHT)
Flow rate: 1.0 mL/min
Injection volume: 0.4 mL In the calculation of the molecular weight of the wax, a molecular weight calibration curve prepared using a standard polystyrene resin (for example, the trade name "TSK standard polystyrene F-850, F-450, F-288, F-128, F-80, F-40, F-20, F-10, F-4, F-2, F-1, A-5000, A-2500, A-1000, A-500" manufactured by Tosoh Corporation) is used. Then, the molecular weight is calculated by polystyrene conversion of the obtained measurement result with a conversion expression derived from the Mark-Houwink viscosity equation.

(3) Weight-Average Particle Diameter (D4) of Toner

The weight-average particle diameter (D4) of a toner is calculated as follows. As the measurement apparatus, a precision particle size distribution measurement apparatus based on a pore electrical resistance method, "Coulter Counter Multisizer 3" (registered trademark, manufactured by Beckman Coulter, Inc.) is used. The setting of measurement conditions and the analysis of measurement data are performed with a dedicated software "Beckman Coulter Multisizer 3 Version 3.51" (manufactured by Beckman Coulter, Inc.) included in the apparatus. The measurement is performed with the number of effective measurement channels set to 25000.

An electrolyte solution prepared by dissolving special grade sodium chloride in ion-exchanged water at a concentration of about 1% by mass, for example, "ISOTON II" (manufactured by Beckman Coulter, Inc.), can be used in the measurement.

The dedicated software is set as described below prior to the measurement and the analysis.

In the changing screen of standard measurement method (SOM) of the dedicated software, the total count number of a control mode is set to 50000 particles, the number of measurement is set to once, and a value obtained using "standard particles: 10.0 μm" (manufactured by Beckman Coulter, Inc.) is set as a Kd value. A threshold and a noise level are automatically set by pressing a threshold/noise level measurement button. In addition, a current is set to 1600 μA, a gain is set to 2, and an electrolyte solution is set to an ISOTON II, and a check mark is placed in the aperture tube is flushed after the measurement.

In the setting screen for conversion from pulse to particle diameter of the dedicated software, a bin interval is set to a logarithmic particle diameter, the number of particle diameter bins is set to 256, and a particle diameter range is set to the range of 2 to 60 μm.

A specific measurement method is as described below.

(1) About 200 mL of the electrolyte solution is put in a 250-mL round-bottom glass beaker dedicated for the Multisizer 3. The beaker is set in a sample stand, and the electrolyte solution in the beaker is stirred with a stirrer rod at 24 rotations/sec in a counterclockwise direction. Then, the dirt and bubbles in the aperture tube are removed by the "aperture flush" function of the dedicated software.

(2) About 30 mL of the electrolyte solution is put in a 100-mL flat-bottom glass beaker. About 0.3 mL of a diluted solution prepared by diluting a "Contaminon N" (a 10% by mass aqueous solution of a neutral detergent for washing a precision measuring device composed of a nonionic surfactant, an anionic surfactant, and an organic builder and having a pH of 7, manufactured by Wako Pure Chemical Industries, Ltd.) with ion-exchanged water by about three mass fold is added as a dispersing agent to the beaker.

(3) An ultrasonic dispersing device having an electrical output of 120 W, "Ultrasonic Dispersion System Tetra 150" (manufactured by Nikkaki Bios Co., Ltd.), in which two oscillators each having an oscillatory frequency of 50 kHz are built-in with a phase displacement of 180° from each other is prepared. A predetermined amount of ion-exchanged water is put in the water tank of the ultrasonic dispersing device. About 2 mL of the Contaminon N is then added to the water tank.

(4) The beaker in the above (2) is set in the beaker fixing hole of the ultrasonic dispersing device, and the ultrasonic dispersing device is operated. Then, the height position of the beaker is adjusted so that the resonant state of the liquid surface of the electrolyte solution in the beaker becomes maximum.

(5) About 10 mg of a toner is gradually added to the electrolyte solution in the beaker in the above (4) while irradiating the electrolyte solution with the ultrasonic wave and is dispersed therein. The ultrasonic dispersion treatment is further continued for 60 seconds. In the ultrasonic dispersion, the temperature of water in the tank is appropriately adjusted to 10° C. or more and 40° C. or less.

(6) The electrolyte solution in the above (5) in which the toner has been dispersed is dropped with a pipette in the round-bottom beaker in the above (1) set in the sample stand, and the amount of the toner to be measured is adjusted to about 5%. Then, measurement is performed until 50000 particles are counted.

(7) The measurement data is analyzed with the dedicated software included with the apparatus, and the weight-average particle diameter (D4) is calculated. Note that an "average diameter" on the analysis/volume statistics (arithmetic average) screen, when the dedicated software is set to show a graph/% by volume, is the weight-average particle diameter (D4).

EXAMPLES

The present invention is specifically described by examples shown below. Note that the number of part(s) in the examples refers to part(s) by mass unless otherwise specified.

Production of Wax 1

A Fischer-Tropsch wax (melting point: 77° C.) derived from natural gas as a raw material was maintained at a temperature of 180° C. and a pressure of 2 Pa for 30 minutes using a wiped film evaporator. Subsequently, the temperature was stepwise increased to 195° C. to remove 15% by mass of light distillate. Then, the pressure was reduced to 1 Pa, and the temperature was stepwise increased to 280° C. to remove 5% by mass of distillation residues and to obtain a distilled wax fraction at a yield of 80% by mass. From the distilled wax fraction, light distillate was removed at a temperature of 195° C. and a pressure of 0.2 Pa using a molecular distillator to obtain Wax 1 at a final yield of 70% by mass with respect to the raw material. FIG. 1 shows the measurement result of GC/MS analysis of the components volatilized by heating Wax 1 at 200° C. for 10 minutes.

Production of Wax 2

Wax 2 was produced as in production of Wax 1 except that a Fischer-Tropsch wax (melting point: 90° C.) derived from natural gas was used as the raw material wax and that the distillation time was appropriately adjusted. In this production process, 5% by mass of light distillate and 5% by mass of distillation residues were removed with a wiped film evaporator, and then 10% by mass of light distillate was removed with a molecular distillator. The final yield was 80% by mass.

Production of Wax 3

Wax 3 was produced as in production of Wax 1 except that a Fischer-Tropsch wax (melting point: 105° C.) derived from coal was used as the raw material wax and that the distillation time was appropriately adjusted. In this production process, 2.5% by mass of light distillate and 2.5% by mass of distillation residues were removed with a wiped film evaporator, and then 10% by mass of light distillate was removed with a molecular distillator. The final yield was 85% by mass.

Production of Wax 4

Wax 4 was produced as in production of Wax 1 except that a slack wax (melting point: 75° C.) derived from crude petroleum was used as the raw material wax and that the distillation time was appropriately adjusted. In this production process, 15% by mass of light distillate and 5% by mass of distillation residues were removed with a wiped film evaporator, and then 20% by mass of light distillate was removed with a molecular distillator. The final yield was 60% by mass.

Production of Wax 5

Wax 5 was produced as in production of Wax 4 except that the amount of removed light distillate was reduced to 10% by mass by adjusting the molecular distillation time. The final yield of Wax 5 was 70% by mass.

Production of Wax 6

Wax 6 was produced as in production of Wax 4 except that the distillation residue-removing step with a wiped film evaporator was omitted and that the amount of removed light distillate was reduced to 10% by mass by adjusting the molecular distillation time. The final yield of Wax 6 was 75% by mass.

Production of Wax 7

Wax 7 was produced as in production of Wax 1 except that the distillation time using a wiped film evaporator was adjusted. In this production process, 2.5% by mass of light distillate and 2.5% by mass of distillation residues were removed with a wiped film evaporator, and then 10% by mass of light distillate was removed with a molecular distillator. The final yield was 85% by mass.

Production of Wax 8

Wax 8 was produced as in production of Wax 1 except that a slack wax (melting point: 54° C.) derived from crude petroleum was used as the raw material wax and that the distillation time was appropriately adjusted. In this production process, 30% by mass of light distillate and 10% by mass of distillation residues were removed with a wiped film evaporator, and then 30% by mass of light distillate was removed with a molecular distillator. The final yield was 30% by mass.

Production of Wax 9

Wax 9 was produced as in production of Wax 8 except that the amount of removed light distillate was reduced to 20% by mass by adjusting the molecular distillation time. The final yield of Wax 9 was 40% by mass.

Production of Wax 10

Wax 10 was produced as in production of Wax 2 except that the distillation step using a wiped film evaporator was omitted. The final yield of Wax 10 was 90% by mass.

Production of Wax 11

Wax 11 was produced as in production of Wax 3 except that the distillation step using a wiped film evaporator was omitted. The final yield of Wax 11 was 90% by mass.

Production of Wax 12

Wax 12 was produced as in production of Wax 4 except that the distillation step using a wiped film evaporator was omitted. The final yield of Wax 12 was 80% by mass.

Production of Wax 13

Wax 13 was produced as in production of Wax 1 except that a slack wax (melting point: 60° C.) derived from crude petroleum was used as the raw material wax and that the distillation time was appropriately adjusted. In this production process, 15% by mass of light distillate and 15% by mass of distillation residues were removed with a wiped film evaporator, and then 20% by mass of light distillate was removed with a molecular distillator. The final yield was 50% by mass.

Production of Wax 14

Figure 3:
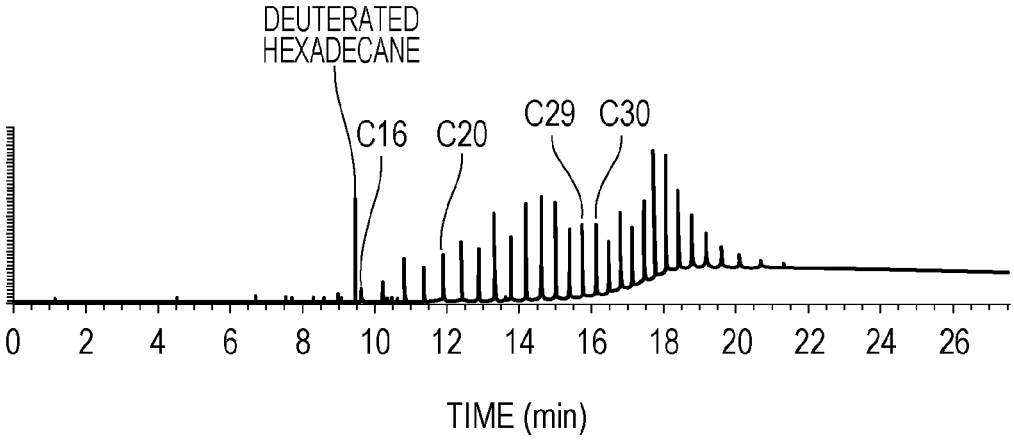
FIG. 3 is a diagram showing the result of GC/MS analysis of components volatilized by heating Wax 14 used in comparative examples of the present invention at 200° C. for 10 minutes.

Wax 14 was produced as in production of Wax 13 except that the amount of removed distillation residues was reduced to 10% by mass by adjusting the distillation time with a wiped film evaporator. The final yield of Wax 14 was 55% by mass. FIG. 3 shows the measurement result of GC/MS analysis of the components volatilized by heating Wax 14 at 200° C. for 10 minutes.

Production of Wax 15

Wax 15 was produced as in production of Wax 1 except that a low-molecular-weight polyethylene wax (melting point: 50° C.) was used as the raw material wax and that the distillation time was appropriately adjusted. In this production process, 25% by mass of light distillate and 10% by mass of distillation residues were removed with a wiped film evaporator, and then 20% by mass of light distillate was removed with a molecular distillator. The final yield was 45% by mass.

Production of Wax 16

Wax 16 was produced as in production of Wax 15 except that the amount of removed light distillate was reduced to 15% by mass by adjusting the distillation time with a wiped film evaporator and that the amount of removed light distillate was increased to 25% by mass by elongating the molecular distillation time. The final yield of Wax 16 was 50% by mass.

Production of Wax 17

Wax 17 was produced as in production of Wax 15 except that the amount of removed light distillate was reduced to 15% by mass by adjusting the distillation time with a wiped film evaporator. The final yield of Wax 17 was 55% by mass.

Production of Wax 18

Wax 18 was produced as in production of Wax 15 except that the amount of removed light distillate was changed to 15% by mass and the amount of removed distillation residues was changed to 15% by mass by appropriately adjusting the distillation time with a wiped film evaporator and that the molecular distillation was omitted. The final yield of Wax 18 was 70% by mass.

Production of Wax 19

Wax 19 was produced as in production of Wax 1 except that a microcrystalline wax (melting point: 82° C.) was used as the raw material wax and that the distillation time was appropriately adjusted. In this production process, 30% by mass of light distillate and 10% by mass of distillation residues were removed with a wiped film evaporator, and then 30% by mass of light distillate was removed with a molecular distillator. The final yield was 30% by mass.

Production of Wax 20

Wax 20 was produced as in production of Wax 1 except that a low-molecular-weight polypropylene wax (melting point: 80° C.) was used as the raw material wax and that the distillation time was appropriately adjusted. In this production process, 20% by mass of light distillate and 20% by mass of distillation residues were removed with a wiped film evaporator, and then 10% by mass of light distillate was removed with a molecular distillator. The final yield was 50% by mass.

Production of Wax 21

Wax 21 was produced as in production of Wax 20 except that the amount of removed light distillate was reduced to 10% by mass and the amount of removed distillation residues was reduced to 10% by mass by adjusting the distillation time with a wiped film evaporator. The final yield of Wax 21 was 70% by mass.

Production of Wax 22

Wax 22 was produced as in production of Wax 21 except that the amount of removed distillation residues was reduced to 5% by mass by adjusting the distillation time with a wiped film evaporator. The final yield of Wax 22 was 75% by mass.

Production of Wax 23

Wax 23 was produced as in production of Wax 20 except that the amount of removed light distillate was reduced to 10% by mass by adjusting the distillation time with a wiped film evaporator and that the distillation residue-removing step was omitted and that the amount of removed light distillate was reduced to 5% by mass by adjusting the molecular distillation time. The final yield of Wax 23 was 85% by mass.

Production of Wax 24

Wax 24 was produced as in production of Wax 1 except that a polyethylene wax (melting point: 105° C.) was used as the raw material wax and that the distillation time with a wiped film evaporator was appropriately adjusted and that the distillation residue-removing step was omitted and that the molecular distillation time was appropriately adjusted. In this production process, 10% by mass of light distillate was removed with a wiped film evaporator, and then 5% by mass of light distillate was removed with a molecular distillator. The final yield was 85% by mass.

Production of Wax 25

Wax 25 was produced as in production of Wax 1 except that a polyethylene wax (melting point: 95° C.) was used as the raw material wax and that the distillation time with a wiped film evaporator was appropriately adjusted and that the distillation residue-removing step was omitted and that the molecular distillation time was appropriately adjusted. In this production process, 10% by mass of light distillate was removed with a wiped film evaporator, and then 5% by mass of light distillate was removed with a molecular distillator. The final yield was 85% by mass.

Production of Wax 26

Wax 26 was produced as in production of Wax 1 except that a slack wax (melting point: 75° C.) derived from crude petroleum was used as the raw material wax and that the distillation time with a wiped film evaporator was adjusted and that the distillation residue-removing step and the molecular distillation step were omitted. In this production process, 5% by mass of light distillate was removed with a wiped film evaporator. The final yield was 95% by mass.

Figure 2:
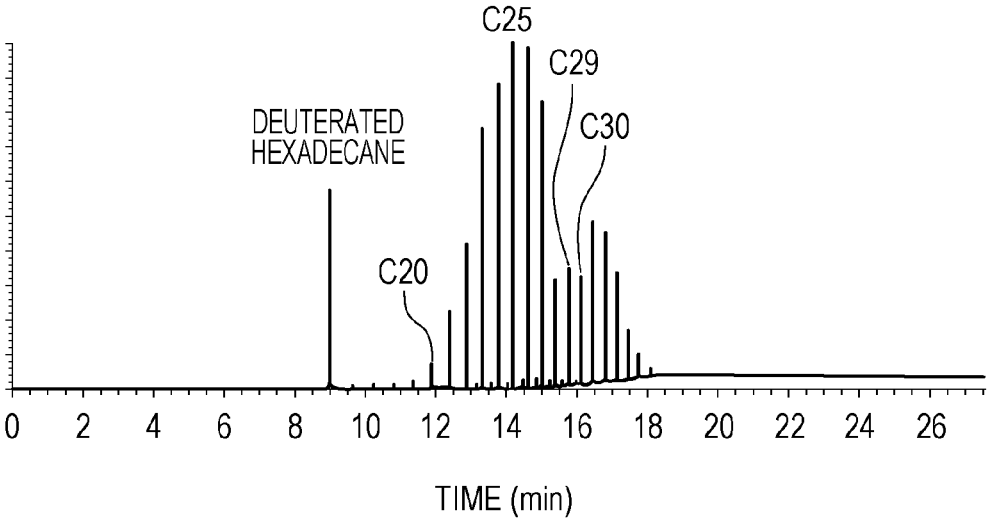
FIG. 2 is a diagram showing the result of GC/MS analysis of components volatilized by heating Wax 26 used in comparative examples of the present invention at 200° C. for 10 minutes.

FIG. 2 shows the measurement result of GC/MS analysis of the components volatilized by heating Wax 26 at 200° C. for 10 minutes.

Production of Wax 27

Wax 27 was produced as in production of Wax 1 except that a low-molecular-weight polypropylene wax (melting point: 80° C.) was used as the raw material wax and that the distillation time with a wiped film evaporator was adjusted and that the distillation residue-removing step and the molecular distillation step were omitted. In this production process, 5% by mass of light distillate was removed with a wiped film evaporator. The final yield was 95% by mass.

Production of Wax 28

Wax 28 was produced as in production of Wax 1 except that a Fischer-Tropsch wax (melting point: 77° C.) derived from natural gas was used as the raw material wax and that the distillation time with a wiped film evaporator was adjusted and that the distillation residue-removing step and the molecular distillation step were omitted. In this production process, 5% by mass of light distillate was removed with a wiped film evaporator. The final yield was 95% by mass.

Production of Wax 29

Wax 29 was produced as in production of Wax 1 except that a polyethylene wax (melting point: 115° C.) was used as the raw material wax and that the distillation time with a wiped film evaporator was appropriately adjusted and that the distillation residue-removing step and the molecular distillation step were omitted. In this production process, 5% by mass of light distillate was removed with a wiped film evaporator. The final yield was 95% by mass.

Table 1 shows the measurement results of Waxes 1 to 29.

TABLE 1

| Wax No. | Type of wax | Total amount (A) (ppm) | Total amount (B) (ppm) | Total amount (C) (ppm) | (B)/(C) | Peak top temperature of maximum endothermic peak (° C.) | Peak molecular weight [Mp] | Mw/Mn |
|---|---|---|---|---|---|---|---|---|
| 1 | Fischer-Tropsch | 350 | 345 | 5 | 69.0 | 78.0 | 520 | 1.20 |
| 2 | Fischer-Tropsch | 90 | 80 | 10 | 8.0 | 92.0 | 620 | 1.10 |
| 3 | Fischer-Tropsch | 180 | 155 | 25 | 6.2 | 107.0 | 720 | 1.40 |
| 4 | Paraffin | 700 | 525 | 175 | 3.0 | 77.0 | 510 | 1.30 |
| 5 | Paraffin | 840 | 570 | 270 | 2.1 | 76.0 | 500 | 1.40 |
| 6 | Paraffin | 910 | 580 | 330 | 1.8 | 75.0 | 490 | 1.50 |
| 7 | Fischer-Tropsch | 800 | 595 | 205 | 2.9 | 77.5 | 510 | 1.25 |
| 8 | Paraffin | 1480 | 570 | 910 | 0.6 | 72.0 | 510 | 1.25 |
| 9 | Paraffin | 1480 | 525 | 955 | 0.5 | 72.0 | 510 | 1.25 |
| 10 | Fischer-Tropsch | 112 | 72 | 40 | 1.8 | 90.0 | 580 | 1.20 |
| 11 | Fischer-Tropsch | 200 | 10 | 190 | 0.1 | 105.0 | 730 | 1.50 |
| 12 | Paraffin | 940 | 260 | 680 | 0.4 | 75.0 | 480 | 1.60 |
| 13 | Paraffin | 1100 | 350 | 750 | 0.5 | 65.0 | 420 | 2.50 |
| 14 | Paraffin | 1200 | 340 | 860 | 0.4 | 65.0 | 380 | 2.50 |
| 15 | Polyethylene | 1300 | 350 | 950 | 0.4 | 63.0 | 380 | 4.50 |
| 16 | Polyethylene | 1300 | 330 | 970 | 0.3 | 60.0 | 380 | 5.50 |
| 17 | Polyethylene | 1400 | 300 | 1100 | 0.3 | 55.0 | 380 | 5.50 |
| 18 | Polyethylene | 1450 | 200 | 1250 | 0.2 | 48.0 | 380 | 5.50 |
| 19 | Microcrystalline | 500 | 350 | 150 | 2.3 | 85.0 | 780 | 1.30 |
| 20 | Polypropylene | 600 | 100 | 500 | 0.2 | 82.0 | 1300 | 1.70 |
| 21 | Polypropylene | 1300 | 550 | 750 | 0.7 | 81.0 | 1500 | 3.50 |
| 22 | Polypropylene | 1300 | 500 | 800 | 0.6 | 81.0 | 1500 | 4.80 |
| 23 | Polypropylene | 1400 | 500 | 900 | 0.6 | 83.0 | 1500 | 5.20 |
| 24 | Polyethylene | 1100 | 150 | 950 | 0.2 | 109.0 | 1700 | 5.20 |
| 25 | Polyethylene | 1490 | 595 | 895 | 0.7 | 100.0 | 800 | 7.00 |
| 26 | Paraffin | 1550 | 500 | 1050 | 0.5 | 75.0 | 440 | 1.70 |
| 27 | Polypropylene | 1450 | 620 | 830 | 0.7 | 80.0 | 1500 | 5.20 |
| 28 | Fischer-Tropsch | 1550 | 1320 | 230 | 5.7 | 77.0 | 500 | 1.30 |
| 29 | Polyethylene | 1700 | 650 | 1050 | 0.6 | 115.0 | 900 | 7.00 |

Example 1

A suspension polymerization toner was produced by the following procedure.

An aqueous medium having a pH of 5.2 was prepared by adding 9 parts by mass of tricalcium phosphate and 11 parts by mass of 10% hydrochloric acid to 1300 parts by mass of ion-exchanged water heated at 60° C. and stirring the resulting mixture using a TK-type homomixer (manufactured by Tokushu Kika Kogyo Co., Ltd.) at 10000 r/min.

Meanwhile, a pigment dispersion composition was prepared by dispersing a mixture composed of:

styrene: 40.0 parts by mass,

C.I. Pigment Blue 15:3:6.5 parts by mass, charge control agent Bontron E-88 (manufactured by Orient Chemical Industries, Ltd.): 1.0 parts by mass, and charge control resin [FCA-1001-NS (manufactured by Fujikura Kasei Co., Ltd.)]: 1.0 parts by mass, with a Star Mill LMZ 22 (manufactured by Ashizawa Finetech Ltd.) for 3 hours.

In addition, a dissolving solution was prepared in another container by dissolving the following materials with a propeller type stirring apparatus at 100 r/min:

styrene: 30.0 parts by mass, n-butyl acrylate: 30.0 parts by mass, saturated polyester resin: 5.0 parts by mass, and [product of isophthalic acid/terephthalic acid/trimellic anhydride/bisphenol A propylene oxide (2 mol) adduct/bisphenol A propylene oxide (3 mol) adduct=50% by mol/50% by mol/0.1% by mol/88% by mol/22% by mol] (acid value: 10 mg KOH/g, peak molecular weight: 10000, weight-average molecular weight: 9900, Tg: 72° C.)

Then, to the above-mentioned dissolving solution,

Wax 1: 10.0 parts by mass, and divinyl benzene: 0.20 parts by mass, were added, followed by addition of the aforementioned pigment dispersion composition. Subsequently, the resulting mixture solution was heated to 65° C. and was stirred with a TK-type homomixer (manufactured by Tokushu Kika Kogyo Co., Ltd.) at 10000 r/min to prepare a polymerizable monomer composition.

Then, the polymerizable monomer composition was added to the aqueous medium. To the resulting mixture, 8.0 parts by mass of Perbutyl PV (10-hour half-life temperature: 54.6° C. (manufactured by NOF Corp.)) was added as a polymerization initiator, followed by stirring at 70° C. with a TK-type homomixer at 10000 r/min for 20 minutes to granulate the polymerizable monomer composition.

The aqueous dispersion of this polymerizable monomer was transferred to a propeller type stirring apparatus and was subjected to a reaction for polymerization at 70° C. for 5 hours and then at 80° C. for 5 hours with stirring at 120 r/min to produce toner particles. After the completion of the polymerization, the slurry containing the particles was cooled and washed with ten times its own volume of water, filtered, and dried, and then subjected to classifying to adjust the particle diameters to obtain toner particles.

Based on 100 parts by mass of the toner particles, 1.7 parts by mass of hydrophobic silica fine powders (primary particle diameter: 7 nm, BET specific surface area: 130 $m^2/g$), which were silica fine powders treated with 20% by mass of dimethyl silicone oil and were frictionally charged to negative polarity, were added as a fluidity-improving agent. The resulting mixture was mixed with a Henschel mixer (manufactured by Mitsui Miike Machinery Co., Ltd.) at 3000 r/min for 15 minutes to obtain toner No. 1 having a weight-average particle diameter (D4) of 6.5 μm. The physical properties of toner No. 1 are shown in Table 2. Toner No. 1 was subjected to the following evaluation. The evaluation results are shown in Table 3. Note that the wax content in Table 2 is the content of a wax based on 100.0 parts by mass of a binder resin.

Inside Contamination Evaluation

Toner No. 1 was subjected to a durability test of 200000 sheets using a commercially available laser beam printer LBP 9500C (manufactured by CANON KABUSHIKI KAISHA) provided with the following remodeling: the process speed of the plain paper mode was changed to 360 mm/sec, the process speed of the heavy paper mode was changed to 90 mm/sec, and the fixing temperature was set to 200° C. An original chart formed with a printing ratio of 5% for each color (full color printing ratio: 20%) was used as the chart of durability evaluation. A cyan cartridge in which all stations for yellow, magenta, cyan, and black were refilled with toner No. 1 was mounted on the printer, and printing was continued by exchanging the cartridge in which the toner was consumed with a new one.

The durability test was performed under each environment of a high-temperature and high-humidity (temperature: 30° C., humidity: 80% RH) environment, an ordinary-temperature and ordinary-humidity (temperature: 23° C., humidity: 50% RH) environment, and a low-temperature and low-humidity (temperature: 15° C., humidity: 10% RH) environment through a printing test of 200000 sheets in total by repeating feeding 8000 sheets of A4 size paper having a basis weight of 68 $g/m^2$ at the plain paper mode and feeding 2000 sheets of Letter size paper having a basis weight of 220 $g/m^2$ at the heavy paper mode.

After the durability test, the contamination state around the fixing device was visually observed and was evaluated by the following criteria:

A: no distinct contamination is observed around the fixing device,

B: slight contamination is observed around the fixing device,

C: contamination spreading to a fixing guiding member is clearly observed, and

D: a high level of contamination is distinctly observed around the fixing device.

Half-Tone Image Reproducibility

Occurrence of vertical lines on images caused by inside contamination to, for example, the transfer belt was visually evaluated by half-tone images, and in order to more early and more strictly verify the occurrence of lines, occurrence of vertical lines was visually evaluated by outputting half-tone images without dithering (images in which the half-tone was reproduced by adjusting only laser light quantity without performing the pseudo half-tone process).

The half-tone image reproducibility was evaluated by outputting a half-tone image and a half-tone image without dithering every after feeding of 1000 sheets in the durability test described in the section of "Inside contamination evaluation" and investigating the worst images through the durability test according to the following criteria:

A: both half-tone images are satisfactory without vertical lines,

B: no line is recognized in the half-tone image, but a slight line is recognized in the half-tone image without dithering, C: a vertical line is hardly recognized in the half-tone image, but a vertical line is clearly recognized in the half-tone image without dithering, and D: distinct vertical lines are recognized in both half-tone images.

Density Stability

Density stability was evaluated by outputting original images each having 20-mm square solid black patches at nine positions in the developing area and comparing the maximum density difference in image density of the nine-point average density of the image in the durability test from that of the initial image. The image concentration was measured using "Macbeth Reflection densitometer RD-918" (manufactured by GretagMacbeth Corp.) as a relative density with respect to an image of the white portion having an original density of 0.00.

The density stability was evaluated for the original image samples output every after feeding of 1000 sheets in the test under a high-temperature and high-humidity (temperature: 30° C., humidity: 80% RH) environment described in the section of "Inside contamination evaluation" according to the following criteria:

A: a maximum density difference of less than 0.15,

B: a maximum density difference of 0.15 or more and less than 0.25,

C: a maximum density difference of 0.25 or more and less than 0.30, and

D: a maximum density difference of 0.30 or more.

Heavy Paper Gloss Uniformity

Fixed image uniformity was evaluated according to the following criteria by outputting an entire solid image (leading edge margin: 5 mm, toner laid-on level: 0.45 $mg/cm^2$) on HP Color Laser Photo Paper, glossy (220 $g/m^2$) manufactured by Hewlett-Packard Company at the heavy paper mode (process speed: 90 mm/sec, fixing temperature: 200° C.), measuring the maximum value and the minimum value of 75° gloss in the fixed image, and determining the difference thereof.

The output was performed under a low-temperature and low-humidity (temperature: 15° C., humidity: 10% RH) environment, and the gloss was measured using black glass having a glossiness of 96.9 as a reference surface with PG-3D (incident angle θ: 75°) manufactured by Nippon Denshoku Industries Co., Ltd. The criteria are as follows:

A: a glossiness difference of less than 2.0%,

B: a glossiness difference of 2.0% or more and less than 4.0%,

C: a glossiness difference of 4.0% or more and less than 6.0%, and

D: a glossiness difference of 6.0% or more.

Example 2

An emulsion aggregation toner was produced by the following procedure.

Preparation of Resin Particle Dispersion 1

The following materials:

styrene: 90.0 parts by mass, n-butyl acrylate: 20.0 parts by mass, acrylic acid: 3.0 parts by mass, dodecanethiol: 6.0 parts by mass, and carbon tetrabromide: 1.0 parts by mass were mixed and dissolved. The resulting mixture was dispersed in a solution prepared by dissolving 1.5 parts by mass of a nonionic surfactant (Nonipol 400, manufactured by Sanyo Chemical Industries, Ltd.) and 2.5 parts by mass of an anionic surfactant (Neogen SC, manufactured by Daiich Kogyo Seiyaku Co., Ltd.) in 140 parts by mass of ion-exchanged water in a flask, followed by emulsification. Ten parts by mass of ion-exchanged water dissolving 1 part by mass of ammonium persulfate was added to this emulsion while gently mixing the emulsion for 10 minutes, and nitrogen substitution was carried out. Then, the content in the flask was heated to 70° C. in an oil bath with stirring, and the emulsion polymerization was continued at this state for 5 hours. Thus, resin particle dispersion 1 in which resin particles having an average particle diameter of 0.17 μm, a glass transition point of 57° C., and a weight-average molecular weight (Mw) of 11000 were dispersed was prepared.

Preparation of Resin Particle Dispersion 2

The following materials:

styrene: 75.0 parts by mass, n-butyl acrylate: 25.0 parts by mass, and acrylic acid: 2.0 parts by mass, were mixed and dissolved. The resulting mixture was dispersed in a solution prepared by dissolving 1.5 parts by mass of a nonionic surfactant (Nonipol 400, manufactured by Sanyo Chemical Industries, Ltd.) and 3 parts by mass of an anionic surfactant (Neogen SC, manufactured by Daiich Kogyo Seiyaku Co., Ltd.) in 140 parts by mass of ion-exchanged water in a flask, followed by emulsification. Ten parts by mass of ion-exchanged water dissolving 0.8 parts by mass of ammonium persulfate was added to this emulsion while gently mixing the emulsion for 10 minutes, and nitrogen substitution was carried out. Then, the content in the flask was heated to 70° C. in an oil bath with stirring, and the emulsion polymerization was continued at this state for 5 hours. Thus, resin particle dispersion 2 in which resin particles having an average particle diameter of 0.1 μm, a glass transition point of 61° C., and a weight-average molecular weight (Mw) of 550000 were dispersed was prepared.

Preparation of Wax Particle Dispersion

The following materials:

Wax 2 (melting point: 92° C.): 50.0 parts by mass, anionic surfactant (Neogen SC, manufactured by Daiich Kogyo Seiyaku Co., Ltd.): 5.0 parts by mass, and ion-exchanged water: 200.0 parts by mass were heated to 95° C. and were subjected to dispersion treatment with a homogenizer (Ultra Turrax T50, manufactured by IKA Japan K.K.) and then with a pressure discharge homogenizer to prepare a wax particle dispersion in which wax particles having an average particle diameter of 0.5 μm were dispersed.

Preparation of Coloring Agent Particle Dispersion 1

The following materials:

C.I. Pigment Blue 15:3:20.0 parts by mass, anionic surfactant (Neogen SC, manufactured by Daiich Kogyo Seiyaku Co., Ltd.): 2.0 parts by mass, and ion-exchanged water: 78.0 parts by mass were mixed and dispersed using a sand grinder mill. The particle size distribution of this coloring agent particle dispersion 1 was measured using a particle size measuring apparatus (LA-700, manufactured by Horiba, Ltd.) to confirm that the average particle diameter of the coloring agent particles contained therein was 0.2 μm and that no coarse particles larger than 1 μm were observed.

Preparation of Charge Control Agent Particle Dispersion

The following materials:

metal compound of dialkyl salicylic acid (charge control agent: Bontron E-88, manufactured by Orient Chemical Industries, Ltd.): 20.0 parts by mass, anionic surfactant (Neogen SC, manufactured by Daiich Kogyo Seiyaku Co., Ltd.): 2.0 parts by mass, and ion-exchanged water: 78.0 parts by mass were mixed and dispersed using a sand grinder mill. The particle size distribution of this charge control agent particle dispersion was measured by a particle size measuring apparatus (LA-700, manufactured by Horiba, Ltd.) to confirm that the average particle diameter of the charge control agent particles contained therein was 0.2 μm and that no coarse particles larger than 1 μm were observed.

Preparation of Mixture Solution

The following materials:

resin particle dispersion 1: 250.0 parts by mass, resin particle dispersion 2: 110.0 parts by mass, coloring agent particle dispersion 1: 50.0 pats by mass, and wax particle dispersion: 80.0 parts by mass were placed in a 1-L separable flask equipped with a stirrer, a cooling tube, and a thermometer and were stirred. This mixture solution was adjusted to a pH of 5.2 with 1N potassium hydroxide.

Formation of Aggregated Particles

To this mixture solution, 150 parts by mass of an aqueous solution of 10% sodium chloride as a flocculant was dropped. The resulting mixture was heated to 57° C. in a heating oil bath with stirring. At this temperature, 3 parts by mass of resin particle dispersion 2 and 10 parts by mass of charge control agent particle dispersion were added to the mixture. The resulting mixture was kept at 50° C. for 1 hour and was then observed under an optical microscope to confirm that aggregated particles (A) having a weight-average particle diameter of about 5.3 μm were formed.

Fusion Process

Subsequently, 3 parts by mass of an anionic surfactant (Neogen SC, manufactured by Daiich Kogyo Seiyaku Co., Ltd.) was further added to the mixture above. The resulting mixture was put in a stainless steel flask, and the flask was sealed. The mixture was heated to 105° C. while continuing stirring using a magnetic seal and was maintained in that state for 1 hour. Then, after cooling, the reaction product was collected by filtration, sufficiently washed with ion-exchanged water, and then dried to obtain toner particles (2) having a weight-average particle diameter (D4) of 6.0 μm. A hundred parts by mass of the toner particles (2) and 1.8 parts by mass of hydrophobic silica fine powders (primary particle diameter: 7 nm, BET specific surface area: 130 $m^2/g$), which were silica fine powders treated with 20% by mass of dimethyl silicone oil and were frictionally charged to negative polarity, were put in a Henschel mixer and were mixed at 3000 r/min for 15 minutes to obtain toner No. 2. The physical properties of the obtained toner No. 2 are shown in Table 2. Toner No. 2 was evaluated as in Example 1, and the evaluation results are shown in Table 3.

Example 3

A toner by pulverization was produced by the following procedure.

A styrene-butyl acrylate copolymer A (St/BA:80/20, Tg: 67° C., Mw: 820000) was produced by suspension polymerization using 2,2-bis(4,4-di-t-butylperoxycyclohexyl)propane as a polymerization initiator. In addition, a styrene-butyl acrylate copolymer B (St/BA: 85/15, Tg: 61° C., Mw: 15800) was produced by solution polymerization using di-t-butyl peroxide as a polymerization initiator. Thirty parts by mass of copolymer A and 70 parts by mass of copolymer B were mixed in a solution to give binder resin 1.

The following materials:

binder resin: 1100.0 parts by mass,

C.I. Pigment Blue 15:3: 6.0 parts by mass, charge control agent, Bontron E-88 (manufactured by Orient Chemical Industries, Ltd.): 1.0 parts by mass, and wax: 34.0 parts by mass were pre-mixed with a Henschel mixer and then kneaded with a biaxial kneading extruder set to a temperature of 110° C. The resulting kneaded product was cooled and then roughly pulverized with a cutter mill and further finely pulverized with a jet stream pulverizer. The particles were classified with a multi-division classifier utilizing the Coanda effect to obtain toner particles having a weight-average particle diameter of 6.5 μm. To 100 parts by mass of the toner particles, 1.7 parts by mass of hydrophobic silica fine powders (primary particle diameter: 7 nm, BET specific surface area: 130 $m^2/g$), which were silica fine powders treated with 20% by mass of dimethyl silicone oil and were frictionally charged to negative polarity, were added as a fluidity-improving agent, and they were mixed in a Henschel mixer (manufactured by Mitsui Miike Machinery Co., Ltd.) at 3000 r/min for 15 minutes to obtain toner No. 3 having weight-average particle diameter (D4) of 6.7 μm. The physical properties of the obtained toner No. 3 are shown in Table 2. Toner No. 3 was evaluated as in Example 1, and the evaluation results are shown in Table 3.

Examples 4 to 10, Comparative Examples 1 to 4, and Comparative Examples 7 to 17

Toner Nos. 4 to 13 and 16 to 27 were produced by suspension polymerization as in Example 1 except that the types and contents of waxes used were changed to those shown in Table 2. The physical properties of toner Nos. 4 to 13 and 16 to 27 are shown in Table 2. Toner Nos. 4 to 13 and 16 to 27 were evaluated as in Example 1, and the evaluation results are shown in Table 3.

Comparative Examples 5, 18, and 19

Toner Nos. 14, 28, and 29 were produced by emulsion aggregation as in Example 2 except that Waxes 10, 24, and 25 were respectively used instead of Wax 2 and that the contents of the waxes were changed to those shown in Table 2. The physical properties of toner Nos. 14, 28, and 29 are shown in Table 2. Toner Nos. 14, 28, and 29 were evaluated as in Example 1, and the evaluation results are shown in Table 3.

Comparative Example 6

Toner No. 15 was produced by pulverization as in Example 3 except that Wax 11 was used instead of Wax 3. The physical properties of toner No. 15 are shown in Table 2. Toner No. 15 was evaluated as in Example 1, and the evaluation results are shown in Table 3.

Comparative Examples 20 to 22

Toner Nos. 30 to 32 were produced by suspension polymerization as in Example 1 except that Waxes 26 to 28 were respectively used and that the content of each wax was changed to 17.0 parts by mass. The physical properties of toner Nos. 30 to 32 are shown in Table 2. Toner Nos. 30 to 32 were evaluated as in Example 1, and the evaluation results are shown in Table 3.

Comparative Example 23

Toner No. 33 was produced by emulsion aggregation as in Example 2 except that Wax 29 was used instead of Wax 2 and that the content of the wax was changed to 17.0 parts by mass. The physical properties of toner No. 33 are shown in Table 2. Toner No. 33 was evaluated as in Example 1, and the evaluation results are shown in Table 3.

TABLE 2

| Toner No. | Wax No. | Wax content (parts by mass) | Production method | Peak top temperature of maximum endothermic peak of toner (° C.) | Endothermic amount of maximum endothermic peak of toner (J/g) | Weight-average particle diameter (μm) |
|---|---|---|---|---|---|---|
| 1 | 1 | 10.0 | Suspension polymerization | 78.0 | 13.3 | 6.5 |
| 2 | 2 | 10.0 | Emulsion aggregation | 92.0 | 14.0 | 6.0 |
| 3 | 3 | 4.0 | Pulverization | 107.0 | 5.0 | 6.7 |
| 4 | 4 | 10.0 | Suspension polymerization | 77.0 | 13.0 | 6.5 |
| 5 | 5 | 10.0 | Suspension polymerization | 76.0 | 13.0 | 6.5 |
| 6 | 6 | 10.0 | Suspension polymerization | 75.0 | 12.8 | 6.5 |
| 7 | 1 | 2.0 | Suspension polymerization | 78.0 | 2.7 | 6.5 |
| 8 | 1 | 14.0 | Suspension polymerization | 78.0 | 18.7 | 6.5 |
| 9 | 1 | 1.0 | Suspension polymerization | 78.0 | 1.3 | 6.5 |
| 10 | 1 | 17.0 | Suspension polymerization | 78.0 | 22.7 | 6.5 |
| 11 | 7 | 17.0 | Suspension polymerization | 77.5 | 22.7 | 6.5 |
| 12 | 8 | 17.0 | Suspension polymerization | 72.0 | 22.7 | 6.5 |
| 13 | 9 | 17.0 | Suspension polymerization | 72.0 | 22.7 | 6.5 |
| 14 | 10 | 10.0 | Emulsion aggregation | 90.0 | 13.3 | 6.0 |
| 15 | 11 | 4.0 | Pulverization | 105.0 | 5.3 | 6.7 |
| 16 | 12 | 10.0 | Suspension polymerization | 75.0 | 13.3 | 6.5 |
| 17 | 13 | 17.0 | Suspension polymerization | 65.0 | 21.0 | 6.5 |
| 18 | 14 | 17.0 | Suspension polymerization | 65.0 | 21.0 | 6.5 |
| 19 | 15 | 17.0 | Suspension polymerization | 63.0 | 21.0 | 6.5 |
| 20 | 16 | 17.0 | Suspension polymerization | 60.0 | 21.0 | 6.5 |
| 21 | 17 | 17.0 | Suspension polymerization | 55.0 | 20.5 | 6.5 |
| 22 | 18 | 17.0 | Suspension polymerization | 48.0 | 20.5 | 6.5 |
| 23 | 19 | 17.0 | Suspension polymerization | 85.0 | 19.0 | 6.5 |
| 24 | 20 | 17.0 | Suspension polymerization | 82.0 | 17.0 | 6.5 |
| 25 | 21 | 17.0 | Suspension polymerization | 81.0 | 16.0 | 6.5 |
| 26 | 22 | 17.0 | Suspension polymerization | 81.0 | 14.0 | 6.5 |
| 27 | 23 | 17.0 | Suspension polymerization | 83.0 | 13.0 | 6.5 |
| 28 | 24 | 17.0 | Emulsion aggregation | 109.0 | 13.0 | 6.0 |
| 29 | 25 | 17.0 | Emulsion aggregation | 100.0 | 19.0 | 6.0 |
| 30 | 26 | 17.0 | Suspension polymerization | 75.0 | 22.0 | 6.5 |

TABLE 2-continued

| Toner No. | Wax No. | Wax content (parts by mass) | Production method | Peak top temperature of maximum endothermic peak of toner (° C.) | Endothermic amount of maximum endothermic peak of toner (J/g) | Weight-average particle diameter (μm) |
|---|---|---|---|---|---|---|
| 31 | 27 | 17.0 | Suspension polymerization | 80.0 | 15.0 | 6.5 |
| 32 | 28 | 17.0 | Suspension polymerization | 77.0 | 22.5 | 6.5 |
| 33 | 29 | 17.0 | Emulsion aggregation | 115.0 | 20.5 | 6.0 |

TABLE 3

| | Toner | Inside contamination | | | Half-tone image reproducibility | | | Concentration | Heavy paper gloss |
|---|---|---|---|---|---|---|---|---|---|
| | No. | H/H | N/N | L/L | H/H | N/N | L/L | stability | uniformity |
| Example 1 | 1 | A | A | A | A | A | A | A (0.07) | A (1.0) |
| Example 2 | 2 | A | A | A | A | A | A | A (0.05) | A (1.4) |
| Example 3 | 3 | A | A | A | A | A | A | A (0.08) | B (3.0) |
| Example 4 | 4 | B | A | A | A | A | A | A (0.08) | A (1.1) |
| Example 5 | 5 | B | B | A | A | A | A | A (0.10) | A (0.8) |
| Comparative Example 1 | 6 | B | B | B | B | A | A | A (0.12) | A (0.7) |
| Example 6 | 7 | A | A | A | A | A | A | B (0.15) | B (2.5) |
| Example 7 | 8 | A | A | A | B | A | A | B (0.15) | A (0.8) |
| Example 8 | 9 | A | A | A | A | A | A | B (0.17) | B (3.5) |
| Example 9 | 10 | A | A | A | B | B | A | B (0.19) | A (1.0) |
| Comparative Example 2 | 11 | B | A | A | C | B | A | B (0.15) | A (1.2) |
| Comparative Example 3 | 12 | C | B | A | C | C | B | B (0.20) | A (1.8) |
| Comparative Example 4 | 13 | C | B | C | C | C | C | B (0.23) | A (1.5) |
| Comparative Example 5 | 14 | B | A | A | B | B | A | A (0.07) | A (1.2) |
| Comparative Example 6 | 15 | B | B | A | B | B | B | A (0.11) | B (2.3) |
| Comparative Example 7 | 16 | C | B | B | B | B | A | A (0.13) | A (0.6) |
| Comparative Example 8 | 17 | C | B | B | C | B | B | B (0.20) | A (1.6) |
| Comparative Example 9 | 18 | C | C | B | C | B | B | B (0.24) | A (1.8) |
| Comparative Example 10 | 19 | C | C | B | C | C | B | B (0.19) | A (1.7) |
| Comparative Example 11 | 20 | C | C | B | C | C | B | B (0.21) | B (2.2) |
| Comparative Example 12 | 21 | C | C | C | C | C | B | B (0.24) | B (2.2) |
| Comparative Example 13 | 22 | C | C | C | C | C | C | C (0.29) | B (2.6) |
| Example 10 | 23 | A | A | A | A | A | A | A (0.14) | B (2.0) |
| Comparative Example 14 | 24 | B | A | A | A | A | A | B (0.22) | B (3.7) |
| Comparative Example 15 | 25 | C | B | B | C | B | B | C (0.25) | C (4.1) |
| Comparative Example 16 | 26 | C | B | B | C | C | B | C (0.26) | C (4.7) |
| Comparative Example 17 | 27 | C | C | B | C | C | B | C (0.27) | C (5.2) |
| Comparative Example 18 | 28 | C | B | B | C | C | B | C (0.28) | C (5.5) |
| Comparative Example 19 | 29 | C | C | C | C | C | C | C (0.29) | B (2.2) |
| Comparative Example 20 | 30 | D | D | C | D | C | C | B (0.19) | A (1.4) |
| Comparative Example 21 | 31 | D | C | C | D | C | C | C (0.26) | B (5.0) |
| Comparative Example 22 | 32 | D | D | C | D | D | C | B (0.17) | A (0.7) |
| Comparative Example 23 | 33 | D | D | D | D | D | C | C (0.27) | D (6.2) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-201066, filed Sep. 8, 2010, which is hereby incorporated by reference herein in its entirety.

The invention claimed is:

1. A toner comprising toner particles, each of which contains a binder resin, a hydrocarbon wax, and a coloring agent, wherein in GC/MS analysis of components volatilized by heating the hydrocarbon wax at 200° C. for 10 minutes, i) a total amount (A) of components showing peaks that are detected on and after the detection time of the peak of hydrocarbon having 16 carbon atoms is 1500 ppm or less;

ii) a total amount (B) of components showing peaks that are detected on and after the detection time of the peak of hydrocarbon having 30 carbon atoms is 570 ppm or less; and iii) when a total amount of components showing peaks that are detected on and after the detection time of the peak of hydrocarbon having 16 carbon atoms and on and before the detection time of the peak of hydrocarbon having 29 carbon atoms is represented by a total amount (C), the total amount (B) and the total amount (C) satisfy a relationship expressed by (B)/(C)≥2.0.

2. The toner according to claim 1, wherein the total amount (C) is 200 ppm or less.

3. The toner according to claim 1, wherein the content of the hydrocarbon wax is 1.0 parts by mass or more and 17.0 parts by mass or less based on 100.0 parts by mass of the binder resin.

4. The toner according to claim 1, wherein the endothermic amount of the endothermic peak in differential scanning calorimetry (DSC) measurement of the toner is 2.0 J/g or more and 20.0 J/g or less.

5. The toner according to claim 1, wherein the hydrocarbon wax has a weight-average molecular weight (Mw) and a number-average molecular weight (Mn) determined by gel permeation chromatography (GPC) so that the ratio, Mw/Mn, is 1.0 or more and 5.0 or less.

6. The toner according to claim 1, wherein the hydrocarbon wax has a peak molecular weight measured by gel permeation chromatography (GPC) of $4.0\times10^2$ or more and $1.4\times10^3$ or less.

* * * * *